United States Patent [19]

Ewbank et al.

[11] 4,050,858

[45] Sept. 27, 1977

[54] WELL PUMPING APPARATUS

[76] Inventors: Phillip K. Ewbank; Charles R. Ewbank; Garen N. Ewbank, all of 513 N. Main, Fairview, Okla. 73737

[21] Appl. No.: 674,012

[22] Filed: Apr. 5, 1976

[51] Int. Cl.[2] ..... F04B 17/00; F04D 13/04

[52] U.S. Cl. ..... 417/234; 417/390; 415/501; 415/169 R

[58] Field of Search ..... 417/390, 375, 405, 234, 417/406, 407, 408, 409; 415/170 R, 501, 169 R, 111

[56] References Cited

U.S. PATENT DOCUMENTS

| | | | |
|---|---|---|---|
| 1,894,393 | 1/1933 | Bigelow | 415/501 |
| 2,149,600 | 3/1939 | Guinard | 417/406 |
| 2,266,577 | 12/1941 | Warren | 415/170 R |
| 2,385,105 | 9/1945 | Samelson | 415/501 |
| 2,621,601 | 12/1952 | Stout | 415/501 |
| 2,798,435 | 7/1957 | Armstrong | 417/234 |
| 3,910,728 | 10/1975 | Sloan | 417/390 |

FOREIGN PATENT DOCUMENTS

| | | | |
|---|---|---|---|
| 990,922 | 5/1965 | United Kingdom | 417/405 |

*Primary Examiner*—Carlton R. Croyle
*Assistant Examiner*—Thomas I. Ross
*Attorney, Agent, or Firm*—Robert K. Rhea

[57] ABSTRACT

A well pumping apparatus including a plurality of hoses windable on a reel journalled by a base having an elongated submersible pump assembly connected with one end of the hoses for lowering and raising the pump assembly into and out of the well. An engine, mounted on the base, drives the reel and a hydraulic pump connected with a pair of the hoses for operating a hydraulic motor and driving a submersed pump contained by the pump assembly and generating a pumping action of the well fluid through one of the hoses. A thrust support and motor mount, connected with the respective end portions of the pump assembly respectively, support an elongated fluid pump drive shaft contained by the pump assembly and provides a fluid port for fluid trapped around the pump drive shaft adjacent the hydraulic motor.

1 Claim, 5 Drawing Figures

WELL PUMPING APPARATUS

BACKGROUND OF THE INVENTION

1. Field of the Invention

The present invention relates to pumping apparatus for water wells, or the like, and more particularly to a portable pumping apparatus for temporary installation at a well location.

A fluid pumping apparatus is frequently needed at particular well locations, such as irrigation projects, army maneuvers or in areas where a disaster has occured and potable water is needed by the survivors. It is sometimes impractical from an investment standpoint to permanently install fluid pumping equipment at irrigation well locations and the time limit does not permit permanent pump installation in disaster areas.

2. Description of the Prior Art

It is known to lower a pump into a well on the end of a hose windable on a reel, such as disclosed by U.S. Pat. No. 2,798,435.

This invention is distinctive over this patent by a fluid pressure operated motor connected with a fluid pump and lowered into the well bore as opposed to fluid injection of some of the well fluid into the well to generate a jet action in removing fluid from the well.

Furthermore, well pump assemblies, as disclosed by the prior art, generally have the disadvantage of a short life of the pump assembly by inadequate support of the pump actuating rod forming a part of the pump assembly thus necessitating frequent repairs and maintanence. Additionally, the pump operating fluid pressure driven motor is frequently damaged by water entering the motor around its drive shaft connected with the pump actuating rod.

This invention provides a pump assembly thrust support and a motor mount with a bleed port which overcomes these objections.

SUMMARY OF THE INVENTION

A base journals a reel for rotation about a horizontal axis extending transversely of the base. A plurality of flexible hoses are connected at one end to one end of the reel and are windable as a unit thereon. The other end of the flexible hoses is connected with one end of an elongated generally cylindrical pump assembly which includes a fluid pressure driven motor connected with a pair of the flexible hoses for operating the pump of the assembly and forcing water through another of the other flexible hoses. An engine, mounted on the base, rotates the reel for lowering the pump assembly and the flexible hoses into a well with the hoses being entrained over an idler pulley journalled by the other end portion of the base. A fluid pump driven by the engine supplies fluid pressure for operating the fluid motor. A collapsible mast, having a manually operated winch, is supported by the idler pulley end portion of the base for raising and lowering the pump assembly from a stored position above the base to a well bore entering position when inserting the pump assembly into the well bore and vice versa when the pumping action is completed. The pump assembly includes a fluid intake or pump housing provided with a pump and coaxial pump drive shaft having an impeller coaxially secured thereto at the depending end portion of the pump drive shaft. The pump drive shaft is supported at its depending end by thrust support members secured to the pump housing. The pump assembly includes a plurality of fluid lifting or staging units surrounding the pump drive shaft in superposed relation above the pump inlet housing. Hydrualic motor mounting members, having a bleed port, are coaxially connected in surrounding relation with respect to a hydraulic motor coaxially connected with the pump drive shaft.

The principal objects of this invention are to provide: a portable well pumping unit having a plurality of hoses connected at one end with a reel and windable thereon by an engine driving the reel; a relatively long life elongated pump assembly connected with the other end of the hoses for lowering and raising the pump assembly into and out of a well, the pump assembly being provided, at its respective end portions, with a thrust support, for supporting a pump drive shaft extending longitudinally of the pump assembly and a bleed port equipped motor mount at its other end portion surrounding a hydraulic pump at the upper end of the pump assembly; and, a hydraulic fluid pump driven by the engine to supply fluid pressure for driving the hydraulic motor.

DESCRIPTION OF THE PREFERRED EMBODIMENTS

Figure 1:
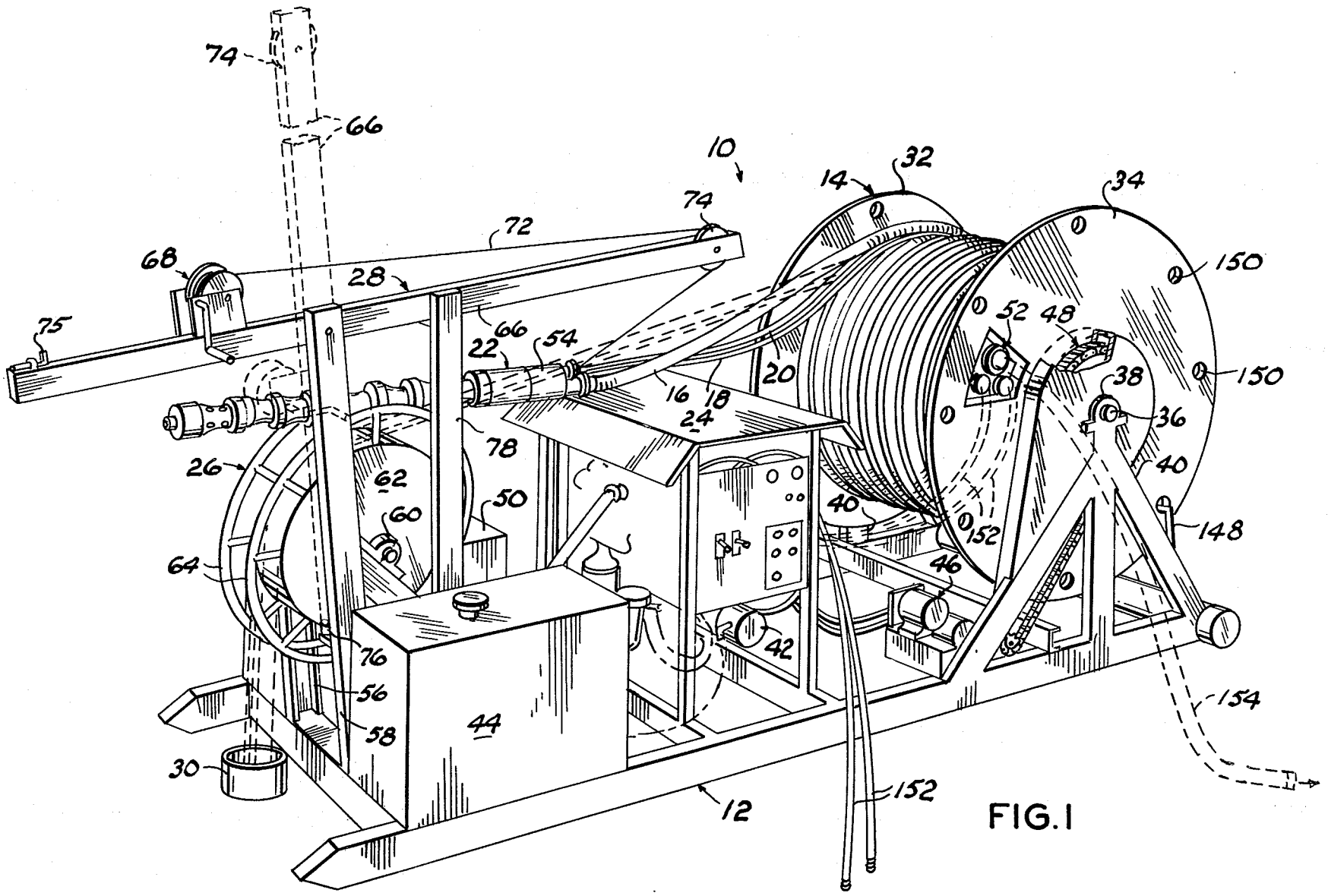
FIG. 1 is a perspective view of the pumping apparatus illustrating, by dotted lines, the relative position of the hoses when the pump assembly has been lowered into a well and the erected position of the pump assembly handling collapsible mast.

Like characters of reference designate like parts in those figures of the drawings in which they occur.

In the drawings:

The reference numeral 10 indicates the pumping apparatus, as a whole, comprising a skid-type base 12, a main reel means 14, a plurality of flexible hoses 16, 18 and 20, a pump assembly 22, engine means 24, and idler pulley means 26 and a collapsible mast means 28. The skid or base means 12 is elongated rectangular flat-like in general configuration and may be flatly disposed on the surface of the earth with one end portion adjacent a well bore, indicated by the upper end portion of well casing 30, wheel supported for towing in trailer fashion, not shown, or mounted on the bed of the truck, not shown, for movement from one well location to another.

The reel means 14 comprises a central drum portion, not shown, secured in a conventional manner to end flanges 32 and 34 in turn secured to an axle 36 extending transversely of one end portion of the base 12 and journalled by bearings 38, only one being shown, supported by upstanding A-frame brace means 40 mounted on the said one end portion of the base.

The engine means 24, such as a stationary internal combustion engine, drives a hydraulic pump 42 with a fluid reservoir 44 to supply fluid pressure for driving a reversible motor and gear train means 46 connected with the reel means 14 by chain and sprocket means 48 for rotating the reel means 14 in opposing directions about the horizontal axis of its axle 36. A tank 50, mounted on the base, supplies fluid for the engine means 24.

The larger diameter hose 16 carries fluid from the pump assembly 22 and the pair of hoses 18 and 20 supply hydraulic fluid for operating the pump assembly as presently explained. The hoses 16, 18 and 20, are wound, as a unit, around the reel means 14 and are connected, in close proximity at one end, with one of the reel flanges, for example the flange 34, by adaptor means 52. The other end of the hoses 16, 18 and 20 is connected with the upper end portion of a hydraulic motor mounting sleeve 54 forming a portion of the upper end portion of the pump assembly 22.

The end portion of the base 12, opposite the reel means 14, is provided with a pair of standards 56 and 58, arranged in parallel spaced relation transversely of the base, which journal the idler pulley means 26 by bearings 60, only one being shown. The pulley means 26 comprises a central drum portion 62 having a pair of endless rings 64 secured in circumferentially spaced parallel relation to the respective end portions of the drum 62 to form a grooved periphery for the idler pulley 26 to freely nest and guide the flexible hoses into and out of the well casing, as explained hereinbelow.

The standard 58 projects upwardly above the upper limit of the idler pulley means 26 for pivotally supporting the mast means 28. The mast means 28 comprises a mast post 66 pivotally connected intermediate its ends with the upper limit of the standard 58 for vertical pivoting action of the mast post 66 about a horizontal axis. The mast post is provided with a manually operated winch means 68, or the like, disposed between its depending end 70 and its connection with the standard 58. The winch means 68 includes a line or cable 72 which is entrained over a pulley 74 journalled by the other end portion of the mast post 66 for connection with the upper end of the pump assembly 22 for the reasons presently explained.

The end portion of the mast post 66, adjacent its end 70, is provided with a latch pin 75 for cooperative engagement in a latch pin socket 76 mounted on the standard 58 for securing the mast post in its upright dotted line position of FIG. 1, for the reasons presently explained.

An upstanding headache post 78, supported by the base between the standard 58 and engine means 24, forms a support for the mast post 66 when the apparatus 10 is not in use.

Referring more particularly to FIGS. 2 through 5, the pump assembly 22 comprises a conventional fluid pump 80 having a housing 82 provided with fluid inlet ports 84 and including an impeller 86 coaxially secured to an elongated pump drive shaft 88 extending longitudinally of the pump assembly. The depending end portion of the pump housing 82 is threadedly connected with a centrally bored thrust support body 90 provided at its upper end with seals such as O-rings 92 respectively sealing with the periphery of the pump drive shaft 88 and inner wall surface of the pump housing 82. The depending end portion of the thrust body 90 is provided with a counterbore 94 which coaxially receives a thrust plate 96 having an axial socket 97 coaxially nesting the depending end portion 98 of the pump drive shaft. Obviously one or more shims, not shown, may be interposed between the depending end of the drive shaft 88 and the bottom of the socket 97. The thrust plate is supported by a thrust bearing 100. A thrust plate retainer or cap 102 is coaxially connected with the thrust body 90 by bolts 104. The cap 102 is centrally bored for receiving a grease fitting, such as a Zerk grease fitting 106, for lubricating the thrust bearing 100. An internally threaded sleeve 108 coaxially surrounds the grease fitting and is integrally formed with the cap 102 and receives a plug 110 to prevent water entering the thrust bearing 100.

A plurality of fluid lifting or staging units 112, only one being shown, surround the pump drive shaft 88 in superposed relation above the pump housing 82. A hydraulic motor mounting means 114, characterized by an annular wall, coaxially surrounds the pump drive shaft 88 and is threadedly connected with the upper end of the uppermost staging unit 112.

The motor mounting means 114 includes an upper end plate 116 which supports a hydraulic motor 118 and is provided with a central aperture 120 having a depending bushing receiving sleeve 122 coaxially secured thereto and terminating in spaced relation with respect to the adjacent end of the stage 112.

Figure 2:
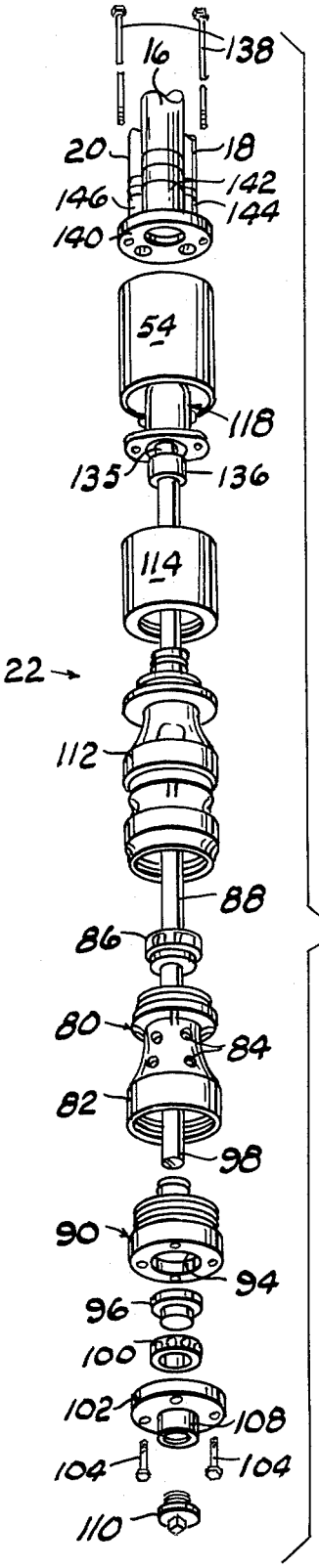
FIG. 2 is a partially exploded perspective view, to a larger scale, of the pump assembly, per se.
Figure 5:
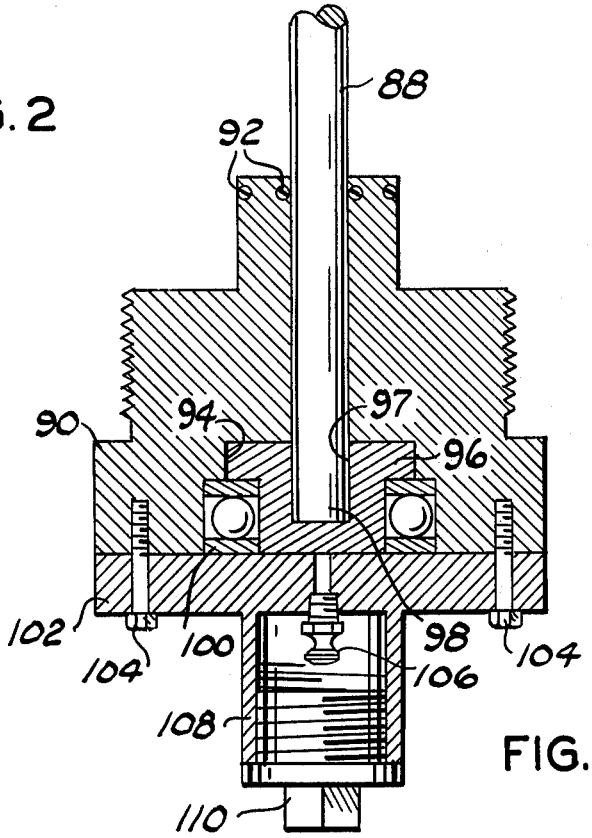
FIG. 5 is a vertical cross sectional view of the pump drive shaft thrust supporting members.
Figure 4:
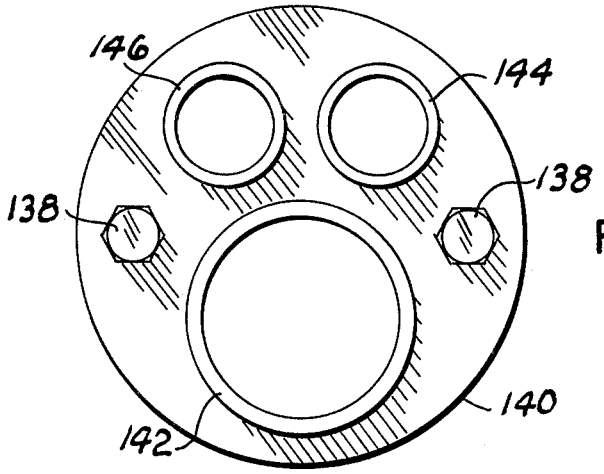
FIG. 4 is a top view of FIG. 3.
Figure 3:
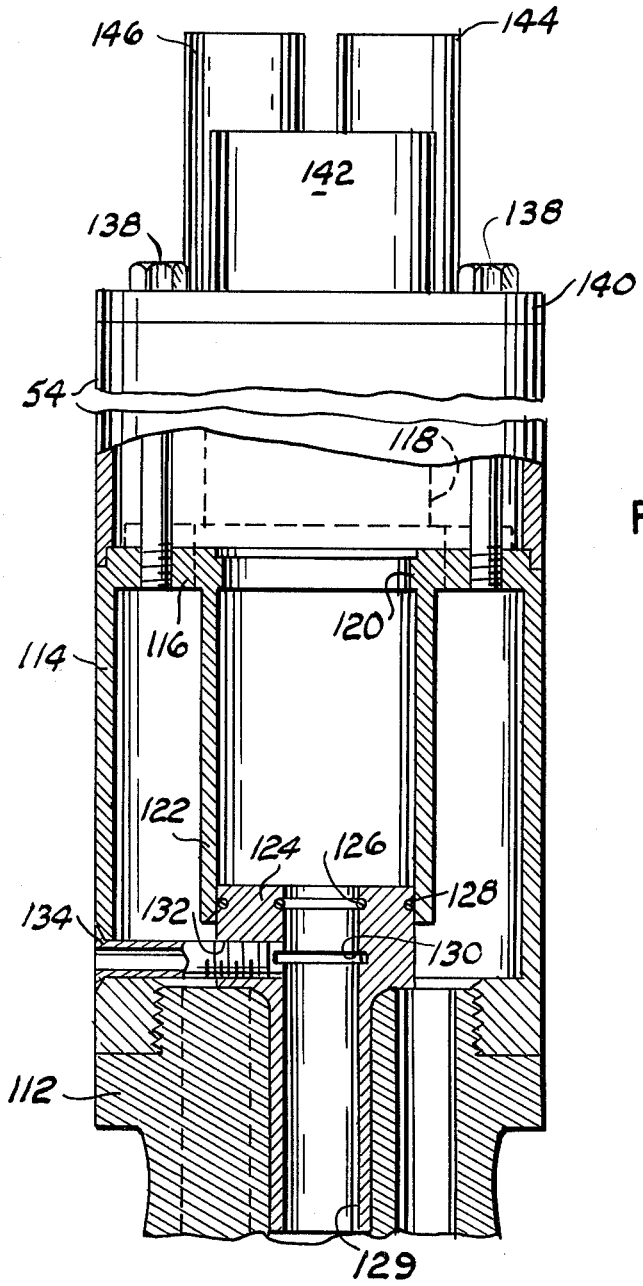
FIG. 3 is a vertical cross sectional view, to a further enlarged scale, partially in elevation, of the hydraulic pump mounting components.

A centrally bored busing 124 is coaxially supported by the uppermost stage 112 and includes a stem portion which surrounds the upper end portion of the pump drive shaft 88 and is sealed therewith by a seal, such as an O-ring 126. The upper diametrically enlarged head end portion of the bushing is closely received by the depending end portion of the sleeve 122 and is sealed therewith by another seal, such as an O-ring 128. Adjacent but spaced downwardly from its upper end, the bore 129 of the bushing is provided with an annular groove 130 in its inner wall surface which communicates with a lateral bore 132 formed in the bushing wall after assembly of the mounting means 114 with the staging unit 112. A tube 134 extends through a bore formed in the wall of the motor mounting means 114 and is threadedly connected with the bushing bore 132 thus forming a port or drain for fluid entering the bushing bore 129 around the pump drive shaft 88 and preventing such fluid from entering the hydraulic motor around its drive shaft 135 (FIG. 2).

The hydraulic motor 118 is connected with the pump drive shaft 88 by a coupling 136 disposed within the sleeve 122. The motor mount sleeve 54 surrounds the hydraulic motor 118 and is coaxially connected with the mounting means 114 by bolts 138 projecting through a sleeve cap 140 overlying the normally upward disposed end of the sleeve 54 and threadedly engaged with the mounting means plate 116. The sleeve cap 140 is provided with a plurality of apertures, respectively, surrounded by coupling members 142, 144 and 146 which are respectively connected with the hoses 16, 18 and 20 at their ends opposite their connecton with the reel flange 34.

OPERATION

In operation, the apparatus 10 is positioned adjacent the casing 30 of a well to be pumped so that the vertical axis of the well bore is tangent to the periphery of the idler pulley drum 62. The winch mast post 66 is raised and secured in its dotted line position (FIG. 1) and the winch line 72, connected with the sleeve cap 140, is wound on the winch 68 to lift the pump assembly 22 so that its longitudinal axis is vertically aligned with the well bore axis. The pump assembly 22 is lowered, by the winch line 72, into the casing 30 until the available slack in the hoses is used and the hoses overlie a peripheral portion of the idler drum 62 and the upper end of the pump assembly is disposed adjacent but spaced above the upper limit of the well casing 30. The winch line 72 is disconnected from the pump assembly 22. The engine means 24 is started and the reel means 14 rotated in a hose unwinding or paying out action to lower the pump assembly 22 into the well bore. When the pump assembly is disposed within the water, not shown, the reel means 14 is secured against further hose unwinding action by a catch rod 148 engaged in an adjacent one of a plurality of apertures 150 (FIG. 1) formed in the reel flange 34. A pair of stub hydraulic supply hoses 152 are connected with the respective fluid pressure supply hoses connecting means 52 communicating with the hoses 18 and 20 to supply fluid pressure for operating the hydraulic motor 118 and rotating the pump shaft 88. Water lifted by the pump assembly 22 and entering the large hose 16 is discharged through an exhaust hose 154 similarly connected at one end with the reel flange supported connecting means 52 communicating with the reel connected end of the hose 16.

When the pumping apparatus is to be moved to another location, the hydraulic motor 118 is stopped and the stub hoses 152 and discharge hose 154 are disconnected from the reel flange 34 and the latch 148 released so that the reel means 14 may be rotated by the reel drive motor 46 in a winding-up action of the hoses 16, 18 and 20 on the reel. When the pump assembly 22 has reached the upper limit of the well casing 30, the winch line 72 is connected with the upper end of the pump assembly and the pump assembly lifted, by the winch 68, out of the casing 30 and horizontally disposed with the upper end portion of the pump assembly overlying and supported by the engine means 24 and the other end portion of the pump assembly supported by the idler pulley 26. The mast post 66 is released and pivoted to its dotted line headache post supported position, shown by solid lines in FIG. 1.

Obviously the invention is susceptible to changes or alterations without defeating its practicability. Therefore, we do not wish to be confined to the preferred embodiment shown in the drawings and described herein.

We claim:

1. In combination with a water well pumping apparatus having an engine driving a reel mounted on a base disposed adjacent a well to be pumped, a plurality of hoses including a well fluid discharge hose connected at one end with said reel and windable thereon, a hydraulic pump driven by said engine and connected with a pair of hoses of said plurality of hoses and having a generally cylindrical pump assembly adapted to be connected at one end with the other end of said plurality of hoses and lowered vertically into the well to be pumped, the pump assembly having an impeller equipped pump contained by a pump housing at its depending end portion, at least one fluid elevating staging means coaxially connected with the upper end of the pump housing and including a coaxial pump drive shaft connected with the impeller at the depending end portion of the pump drive shaft and having a hydraulic motor drivably connected with the upper end of the pump drive shaft, the improvement comprising:

pump drive shaft support means including a centrally bored thrust body coaxially surrounding the depending end portion of said pump drive shaft and connected with said pump housing, said thrust body having a counterbore in its depending end;

thrust bearing means secured within the thrust body counterbore said thrust bearing means including a thrust plate having a socket nesting and supporting the depending end portion of said pump drive shaft, a thrust plate cap secured to the depending end of said thrust body, and, a thrust bearing interposed between said thrust plate and said thrust cap;

hydraulic motor mounting means including an apertured hydraulic motor mounting plate having a depending annular wall coaxially connected with said staging means and surrounding the upper end portion of said pump drive shaft;

a bushing receiving sleeve coaxially disposed within said annular wall;

a bushing surrounding the upper end portion of said pump drive shaft including a stem portion coaxially received by said staging means and having an upstandng head portion at least partially disposed within said bushing sleeve;

sealing means comprising waterproof sealing rings interposed between said bushing head and said bushing sleeve and between said bushing stem and said pump drive shaft, respectively, said bushing head having an annular groove in its wall surface surrounding said pump drive shaft and having a lateral port communicating with the groove, said motor mounting plate annular wall having a lateral port coaxially aligned with the bushing head port;

a drain tube interconnecting the lateral ports;

a hydraulic motor surrounding sleeve coaxially secured to said motor mounting plate; and, a motor mounting and hose connecting cap overlying the end of said motor mounting sleeve opposite said motor mounting plate.

* * * * *